US009518431B2

(12) United States Patent
Webre et al.

(10) Patent No.: US 9,518,431 B2
(45) Date of Patent: Dec. 13, 2016

(54) SLIP-TYPE ELEVATOR ADAPTER

(71) Applicant: Frank's International, LLC, Houston, TX (US)

(72) Inventors: Charles M. Webre, Lafayette, LA (US); Scott Arceneaux, Lafayette, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 411 days.

(21) Appl. No.: 14/050,300

(22) Filed: Oct. 9, 2013

(65) Prior Publication Data

US 2015/0096763 A1 Apr. 9, 2015

(51) Int. Cl.
*E21B 19/07* (2006.01)

(52) U.S. Cl.
CPC ..... *E21B 19/07* (2013.01)

(58) Field of Classification Search
USPC ..... 166/380, 77.52
See application file for complete search history.

(56) References Cited

U.S. PATENT DOCUMENTS 1,669,401 A * 5/1928 Davis ..... E21B 19/07 294/90
6,227,587 B1 * 5/2001 Terral ..... E21B 19/07 188/67
2003/0145984 A1 * 8/2003 Webre ..... E21B 19/165 166/64
2010/0200221 A1 * 8/2010 Sipos ..... E21B 19/07 166/250.01

* cited by examiner

*Primary Examiner* — Taras P Bemko
(74) *Attorney, Agent, or Firm* — MH2 Technology Law Group, LLP

(57) ABSTRACT

Methods and apparatus for adapting an elevator for use with a tubular are provided. The apparatus includes one or more axial extensions configured to engage one or more slip bodies of the elevator. The one or more axial extensions include a radial contact surface configured to slide along the tubular and an axial engagement surface configured to bear on an upset of the tubular. The one or more axial extensions are flexible such that the radial contact surface is radially displaceable with respect to the tubular.

30 Claims, 8 Drawing Sheets

SLIP-TYPE ELEVATOR ADAPTER

BACKGROUND

In oilfield operations, elevators are generally employed to connect a tubular to a hoist, enabling the tubular to be lifted into place, made up to a string of tubulars, and run into a wellbore. One type of elevator is a side-door elevator, which latches onto the tubular and engages the box threaded coupling at one end of the tubular. The other end of the tubular includes a pin threaded coupling, which is received and threaded into the box threaded coupling of the previously-run tubular. Once connected ("made-up") to the rest of the string of tubulars, the string weight is supported by connection between the elevator and the tubular at the threaded coupling.

Another type of elevator is a slip-type elevator, sometimes refereed to as a "YC" elevator. The slip-type elevator includes slips, which may have teeth or be non-marking, that engage the outer diameter of the tubular. Typically, the slips are pushed radially inward into engagement with the outer diameter of the tubular. The radial force is provided by an axial engagement between a setting plate and an upset or shoulder, generally at the end of the shoulder. Using a tapered interface, the axial engagement of the setting plate with the upset is translated into radially-inward force on the slips, causing the slips to engage the tubular. Thus, once made up to the tubular string, the weight of the string is supported by the outer diameter of the tubular, rather than the threaded connection.

However, some tubulars employ an integral swaged or tapered box at the end of the tubular to accommodate the pin of the next tubular. Such integral, swaged box designs incorporate a gradual increase in the inner and outer diameter of the tubular to accommodate the interior threads, allowing the tubular to be made up to the pin connection of the next tubular.

To transfer this type of tubular from a horizontal position (i.e., as stored on the surface) to a vertical position (for being made-up and run in), a threaded insert, referred to as a "lift nubbin" is threaded into the swaged box. The lift nubbin has a larger outer diameter at the top, which serves as the upset. However, this design requires the use of a special bored side door to correctly interface with the shoulder of the lift nubbin, due to the larger outer diameter of the swaged box. Further, slip-type elevators are generally not acceptable for use with the swaged box tubulars, because the taper of the swaged box may cause the slips of the elevator to engage the tapered region of swaged box, resulting in an incomplete engagement of the outer diameter of the tubular. This, in turn, can result in increased local stress in the areas where the slips engage.

SUMMARY

Embodiments of the disclosure may provide an apparatus for adapting an elevator for use with a tubular. The apparatus includes one or more axial extensions configured to engage one or more slip bodies of the elevator. The one or more axial extensions include a radial contact surface configured to slide along the tubular and an axial engagement surface configured to bear on an upset of the tubular. The one or more axial extensions are flexible such that the radial contact surface is radially displaceable with respect to the tubular.

Embodiments of the disclosure may also provide an elevator. The elevator includes an elevator body, and a plurality of slip bodies disposed at least partially within the elevator body and configured to move radially inwards when slid in an axial direction relative to the elevator body, so as to engage an outer diameter of a tubular. The elevator also includes an axial extension engaging at least one of the plurality of slip bodies and extending axially therefrom, the axial extension being flexible so as to flex radially outwards when the axial extension encounters a tapered section of the tubular. The axial extension is configured to bear on an upset of the tubular so as to radially displace the plurality of slip bodies.

Embodiments of the disclosure may also provide a method of manufacturing an elevator adapter. The method includes determining a height of a swaged box of a tubular, and selecting a height of the elevator adapter, such that the height is greater than the height of the swaged box. The elevator adapter includes an axial extension that is configured to radially expand when engaged with a tapered section of the tubular and to transfer an axial force to a plurality of slip bodies when the axial extension engage an upset of the tubular.

It is to be understood that both the foregoing general description and the following detailed description are exemplary and explanatory only and are not restrictive of the present teachings, as claimed.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
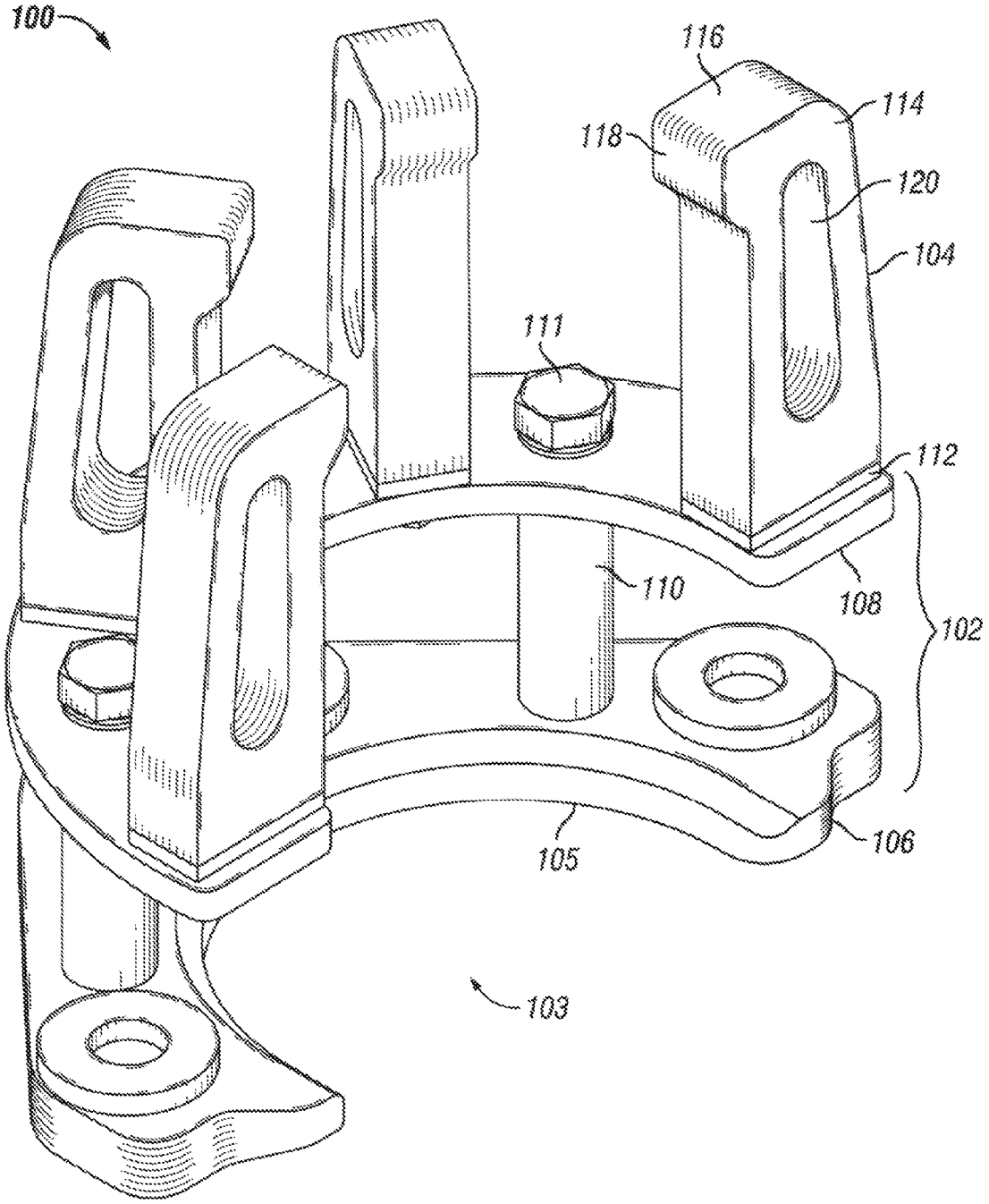
FIG. 1 illustrates a perspective view of an elevator adapter, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms as part thereof, and in Which is shown by way of illustration a specific exemplary embodiment in which the present teachings may be practiced. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

FIG. 1 illustrates a perspective view of an elevator adapter 100, according to an embodiment. The elevator adapter 100 generally includes a base 102 and an axial extension, which may be provided, in an embodiment, by a plurality of "fingers" 104 extending from the base 102. The base 102 may be generally arcuate, as shown, and may extend circumferentially between about 150 and about 200 degrees, for example, about 180 degrees. The base 102 may be sized and shaped so as to receive a tubular, such as a casing, drill pipe, etc. through the open angular section 103 thereof. Accordingly, the base 102 may include a partial inner diameter 105 at least sufficient to receive a nominal outer diameter of the tubular. In other embodiments, the base 102 may be circular and may include, for example, hinges, joints, or the like so as to receive the tubular.

Further, the base 102 may include one or more plates, for example, a first plate 106 and a second plate 108. The first and second plates 106, 108 may be separated by and connected together via a plurality of posts 110. A bolt 111 may extend through the post 110, so as to secure the first and second plates 106, 108 together; however in other embodiments, the first and/or second plates 106, 108 may be secured to the posts 110 via welding, brazing, adhesives, integral forming, and/or the like. The base 102 may be separated into the first and second plates 106, 108, with the posts 110 of a suitable length, so as to provide a desired overall height for the elevator adapter 100, as will be described in greater detail below. In other embodiments, however, one or both of the plates 106, 108 may have an increased height, such that the posts 110 may be omitted. Furthermore, the base 102 may be provided by a single plate of sufficient thickness to provide the desired height.

The fingers 104 may be coupled to the base 102, for example, to the second plate 108 thereof. For example, the lingers 104 may be fastened to the base 102 via fasteners such as bolts, or may be coupled thereto using any other suitable coupling process or device. Further, the fingers 104 may be circumferentially separated and disposed at approximately uniform angular intervals. For example, in the illustrated four finger 104 embodiment, the arcuate base 102 may extend about 180 degrees. Accordingly, one of the fingers 104 may be disposed at each end of the base 102, with the two remaining fingers 104 disposed at about 60 degrees and at about 120 degrees (i.e., at generally uniform 60 degree intervals). Although four fingers 104 are illustrated, it will be appreciated that three or fewer fingers 104, or five or more fingers 104 may be employed without departing from the scope of the present disclosure and may be disposed at uniform or non-uniform intervals of any angle.

The fingers 104 may have a generally elongate shape, each defining a root 112 proximal the connection with the base 102 and a tip 114 that is distal from the base 102. At the tip 114, or proximal thereto, the lingers 104 may each define an axial engagement surface 116 and a radial contact surface 118. The radial contact surface 118 may extend radially inward from a remainder of the finger 104, so as to define a radially innermost point thereof. The axial engagement surface 116 may be generally flat; however, in some embodiments it may be rounded, beveled, stepped, etc. Further, the axial engagement sodium 116 may be positioned at the axial extent of the finger 104. In other embodiments, however, other features of the elevator adapter 100 may extend axially beyond the axial engagement surface 116.

The fingers 104 may be constructed of a flexible material. In some embodiments, the flexible material may be a polymer, elastomer, carbon fiber, a composite material, or the like. In one specific embodiment, the flexible material may be cast polyurethane. In other embodiments, the flexible material may be another elastic material, e.g., a metal, such that the fingers 104 may conceptually and/or visually resemble leaf springs. It will be appreciated that the fingers 104 may be constructed from various combinations of these and/or other materials.

Moreover, the fingers 104 may define a relief 120 therein, e.g., extending therethrough, which may decrease a rigidity of the fingers 104, tor example, by reducing a cross-section thereof. The relief 120 may take any suitable form such as, for example, as series of holes, slots, recesses, etc. In the illustrated embodiment, the relief 120 may be formed as a slot with a shape that generally conforms to the exterior contours of the fingers 104.

Figure 2:
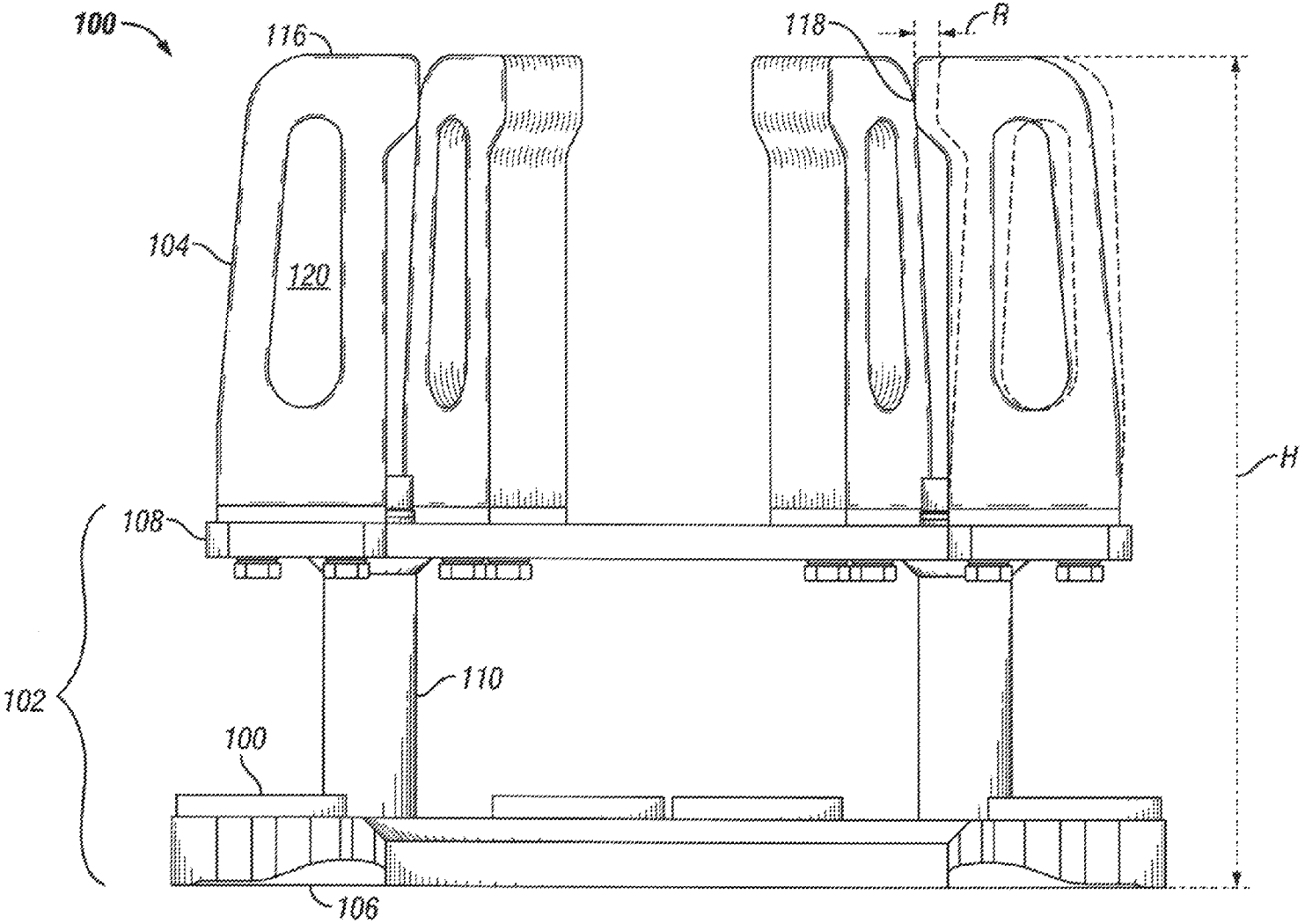
FIG. 2 illustrates a side elevation view of the elevator adapter, according to an embodiment.

FIG. 2 illustrates a side elevation view of the elevator adapter 100, according to an embodiment. As shown, the elevator adapter 100 defines a height H, extending from the bottom of the base 102 to the axial engagement surfaces 116 of the lingers 104. The height H may he predetermined and configured by selecting a number and/or thickness of first and/or second plates 106, 108, a height of the posts 110, and/or a height of the fingers 104.

The flexible Lingers 104, and particularly the tips 114 thereof, may define a radial range of motion R, as indicated, between an unflexed position (indicated in solid) and a flexed position (indicated in dashed lines). Such rate of motion R may enable the tips 114 of the fingers 104 to spread apart when contacting an area of increased outer diameter of the tubular received therein. In at least one embodiment, the radial range of motion R may be sufficient so as to expand the radial contact surface 118 such that it is aligned with the partial inner diameter 105 (FIG. 1) of the base 102. In other embodiments, the radial range of motion R may be even greater, so as to accommodate tubular sections with as larger outer diameter than the partial inner diameter 105. Accordingly, it will be appreciated that in some cases, the height of the fingers 104 may be constrained to a range sufficient to provide the radial range of motion R for the tip 114, while providing sufficient rigidity to as to transfer axially-directed farce to the base 102 without excessive buckling.

Figure 3:
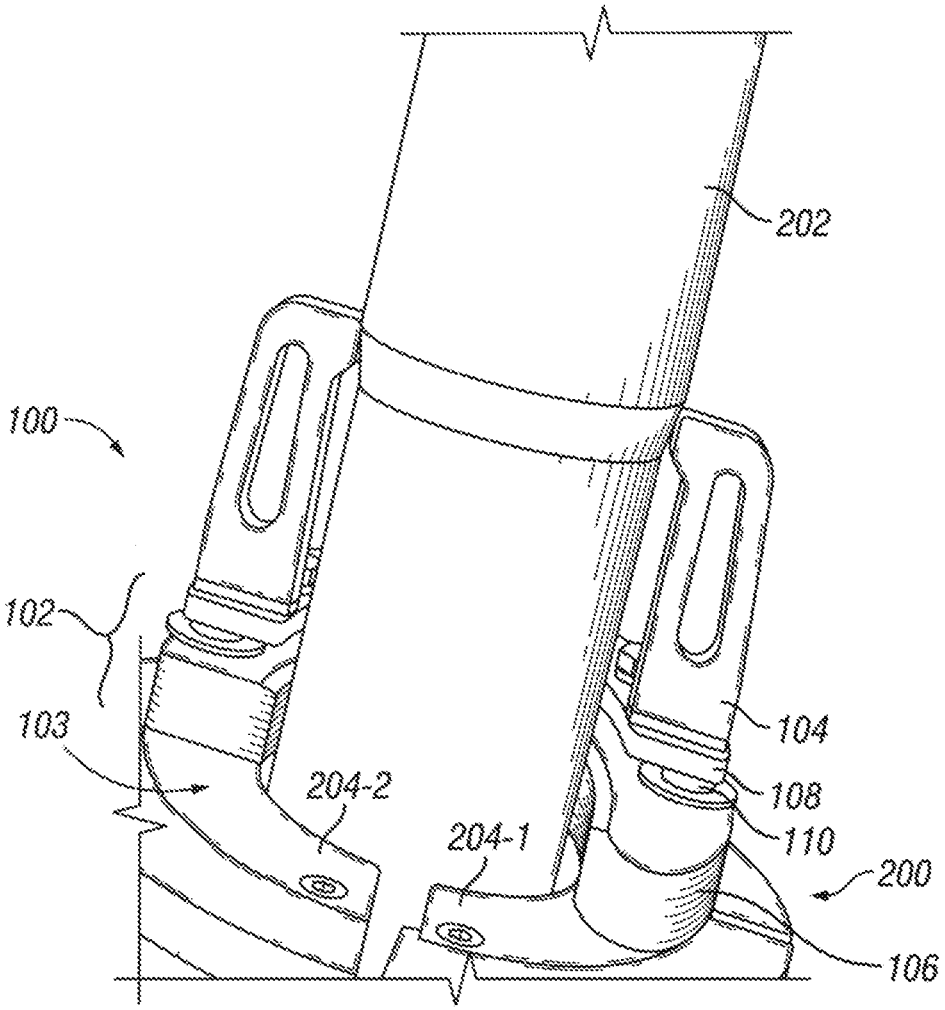
FIG. 3 illustrates a perspective view of the to elevator adapter coupled with an elevator, according to an embodiment.

FIG. 3 illustrates a perspective view of another embodiment of the elevator adapter 100 coupled with an elevator 200 and receiving the tubular 202 through the open angular section 103 thereof, according to an embodiment. The embodiment of the elevator adapter 100 illustrated in FIG. 3 may be generally similar to the embodiment illustrated in FIGS. 1 and 2. However, as shown, the first plate 106 may extend to a greater angular extent than the second plate 108. Further, the first plate 106 may be thicker than the second plate 108, as shown.

The elevator 200 includes slip bodies 204 (two are visible: 204-1 and 204-2), which may be generally arcuate in shape. Further, the slip bodies 204 may be coupled together, such that axial movement of one of the slip bodies 204 may cause corresponding axial movement of the adjacent slip bodies 204. In an embodiment, the elevator 200 may include four slip bodies 204; however, in various other embodiments, any number of slip bodies 204 may be included. The first plate 106 may extend fully across two of the slip bodies 204 (i.e., the two obscured slip bodies 204), may partially extend across another of the slip bodies 204-1, and may not extend across another one of the slip bodies 204-2. In other embodiments, the first plate 106 may extend at least partially across all of the slip bodies 204 and/or may not extend across two or more of the slip bodies 204. In an embodiment, the first plate 106 (and/or another component of the base 102 (FIG. 1)) may extend across at least three of the slip bodies 204, which may serve to avoid or at least minimize canting of the slip bodies 204 relative to one another when an axial force is applied thereto via the first plate 106.

In some embodiments, the first and/or second plates 106, 108 of the base 102 may engage the slip bodies 204, so as to transfer axial force thereto. For example, the first and/or second plate 106, 108 may be rigid or may radially expand and/or contract to accommodate radial displacement of the slip bodies 204. The first plate 106 may be fixed directly to one of the slip bodies 204, such as by one or more mechanical fasteners (or any other coupling device and/or process), for example, in lieu of a slip setting plate. In other embodiments, the first plate 106 may be coupled to the slip plate. It will be appreciated that a slip setting plate is generally an annular structure disposed at the top of an elevator, which transmits an axial force applied thereto to the slip bodies, so as to drive the slip bodies downwards. Such downward driving of the slip bodies causes teeth, pads, other engagement features of the slip bodies to engage the outer diameter of the tubular so as to hold the weight of the tubular and anything attached thereto (e.g., a string of tubulars).

Figure 4:
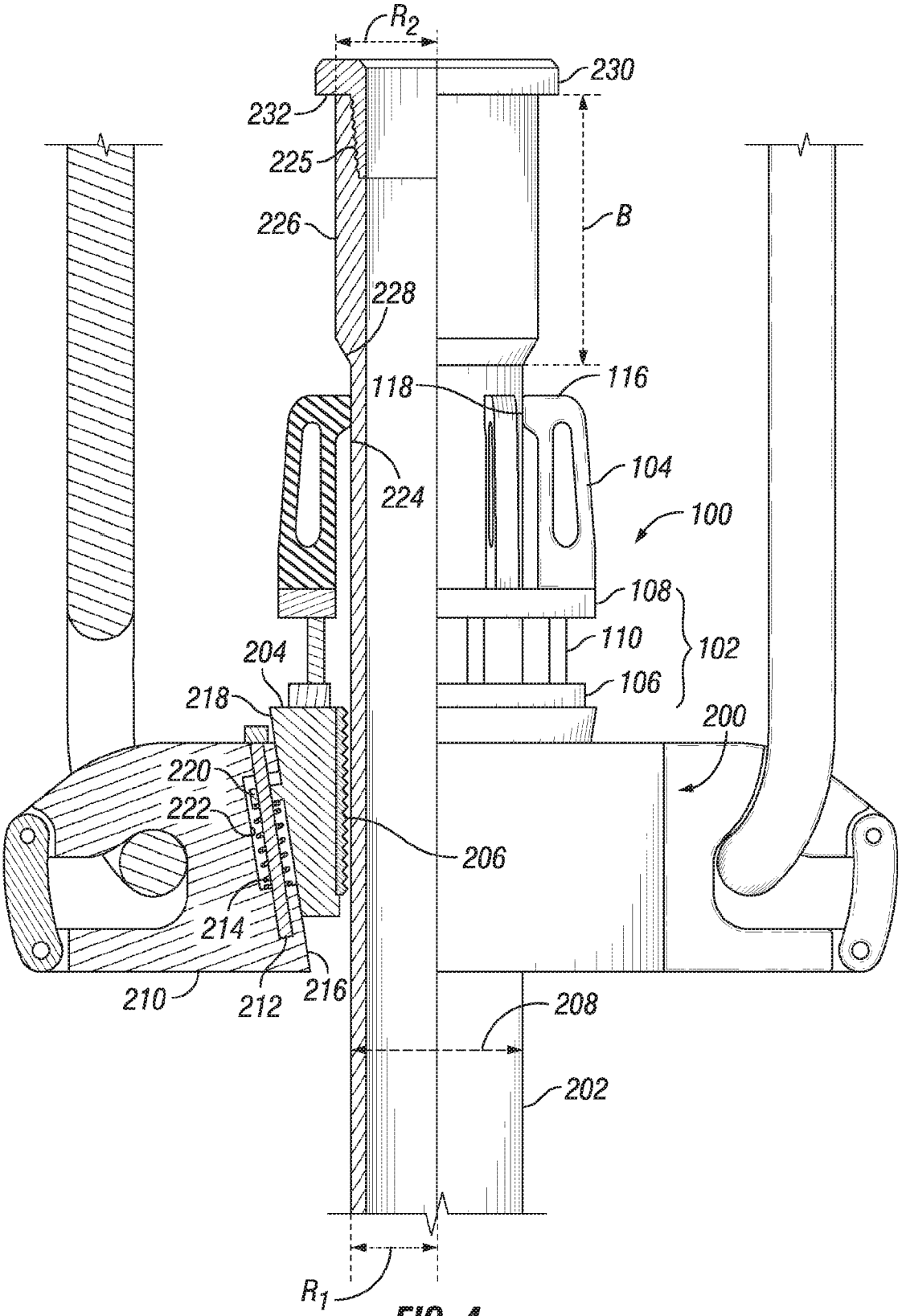
FIGS. 4-7 illustrate quarter-sectional views of the elevator adapter, attached to an elevator and positioned at sequentially higher positions along a tubular, according to an embodiment.
Figure 5:
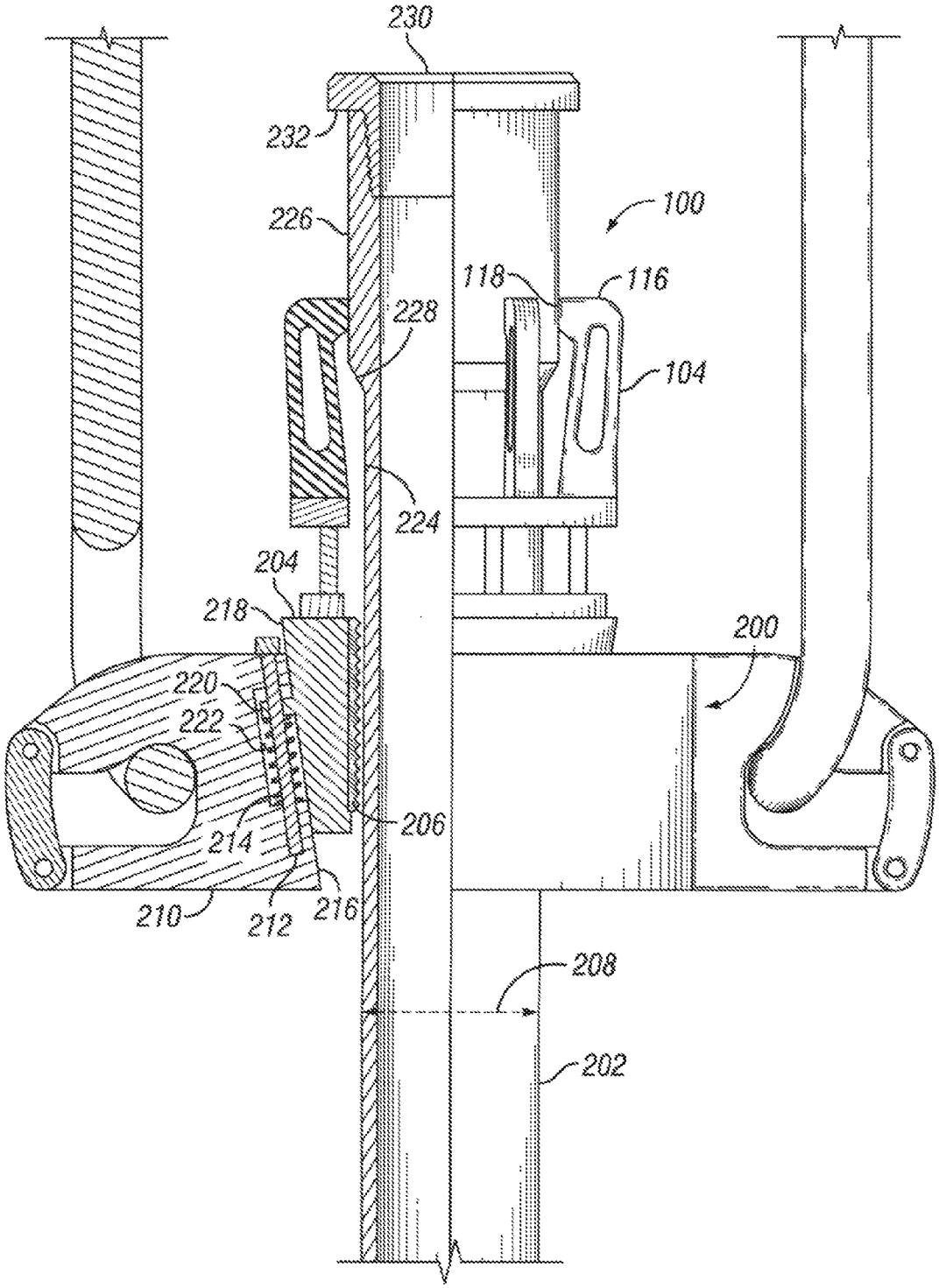
Figure 6:
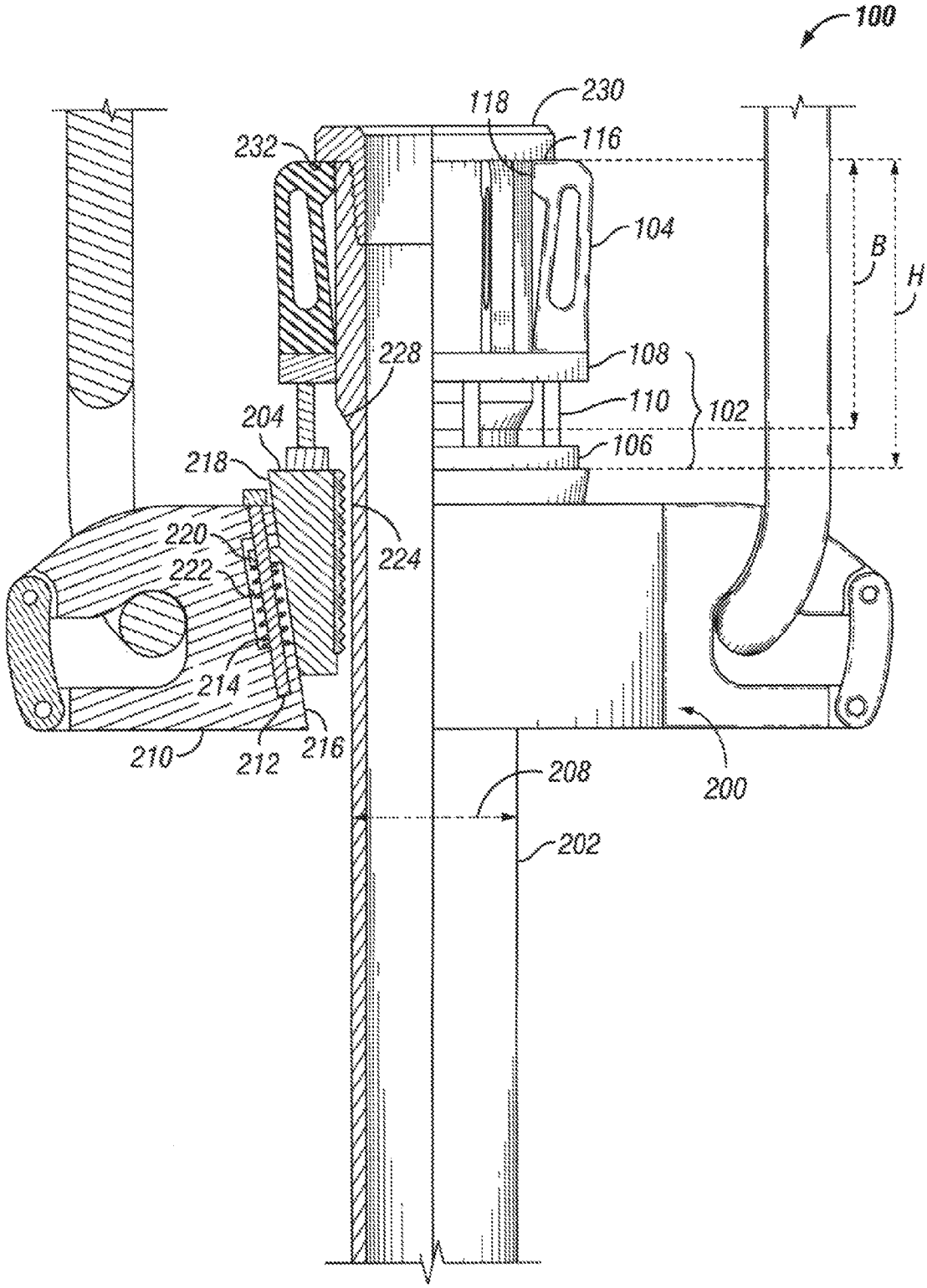
Figure 7:
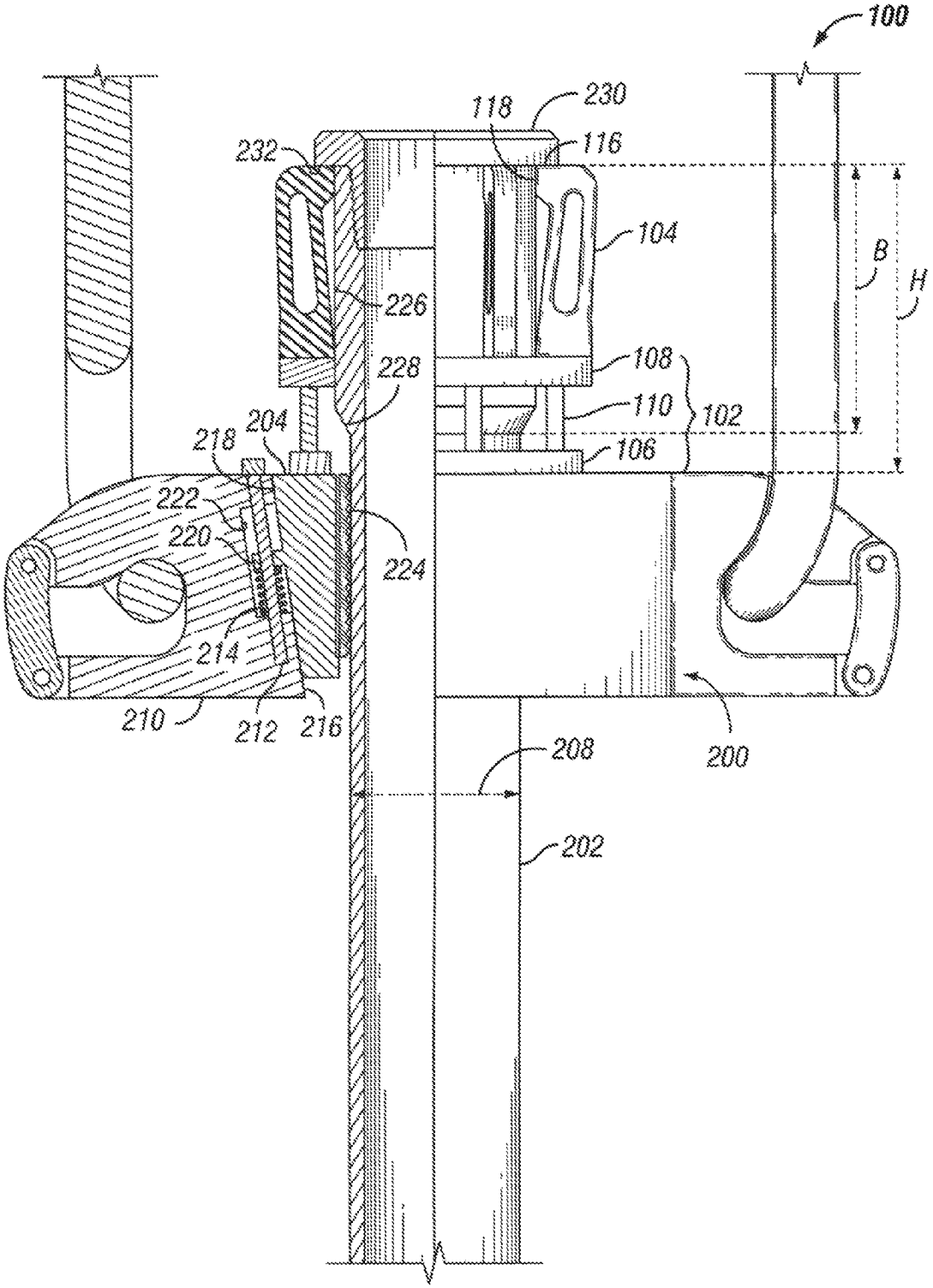

FIGS. 4-6 illustrate quarter-sectional views of the elevator adapter 100 coupled with the elevator 200 and disposed on the tubular 202, according to an embodiment. FIGS. 4-6 may serve to illustrate one potential example of operation of the elevator adapter 100. As shown, the elevator 200 may include the slip bodies 204, which may be coupled with one or more teeth 206 along a radial inside thereof. The teeth 206 may be configured to be driven into an outer diameter 208 of the tubular 202, so as to grip the tubular 202; however, it will be appreciated that non-marking elevators 200 are within the scope of the preset disclosure.

Further, the elevator 200 may include a body 210, a pin 212, and a spring 214. The body 210 may surround the slip bodies 204 and may include a door to laterally receive the tubular 202. The body 210 may define a tapered inner surface 216, and the slip bodies 204 may each define a reverse-tapered outer surface 218. The slip bodies 204 may slide axially relative to the slip body 204, with the tapered inner surface 216 engaging the reverse-tapered outer surfaces 218 such that the axial movement of the slip bodies 204 results in radial displacement thereof. In particular, axial movement of the slip bodies 204 "downward" with respect to the elevator body 210 may result in the slip bodies 204 being displaced radially inwards, into engagement with the tubular 202. At least when the slip bodies 204 are disengaged from the tubular 202, the slip bodies 204 may define circumferential spaces therebetween, so as to allow for the radial displacement radially inward. It will be appreciated that directional references herein (e.g., downward, upward, etc.) are meant to refer to the orientation of the depiction of the embodiment of the drawings, and are not to be considered limiting unless expressly stated otherwise herein.

The slip bodies 204 may also define a tab 220, which may receive the pin 212. The pin 212 may also be received into a recess 222 defined in the elevator body 210. The tab 220 may further be received in the recess 222, so as to slide therein, guided by the pin 212. Additionally, the spring 214 may be disposed around the pin 212 in the recess 222. The spring 214 may bear on the tab 220 and the body 210, such that the slip bodies 204 are biased upwards with respect to the body 210.

The tubular 202 may define a nominal OD (outer diameter) section 224, an increased OD section 226, and a tapered section 228 that connects the nominal OD section 224 with the increased OD section 226. The nominal OD section 224 may extend a majority of the length of the tubular 202. Further, the outer diameter (i.e., the outside circumferential surface) of the tubular 202 in the nominal OD section 224 may define as first radius R1. The outer diameter (i.e., the outside circumferential surface) of the tubular 202 at the increased OD section 226 may define a second radius R2.

Further, the increased OD section 226 and at least a portion of the tapered section 228 ma at least partially make up a box connection of the tubular 202, which may be swaged and/or integral with the nominal OD section 224 of the tubular. Further, along with the increased outer diameter, the box connection may also define an area 225 having an increased inner diameter, so as to accommodate threads configured to mesh with threads of a pin end of a superposed tubular having an outer diameter that is the same size as the nominal OD section 224.

More particularly, the box connection, i.e., the tapered section 228 and the increased OD section 226, may have a box height B. A lift nubbin 230 may be threaded temporarily into the increased OD section 226, i.e., the threaded area 225, such that the box height B is defined between the bottom of the lift nubbin 230 and the bottom of the tapered section 228 (i.e., the edge of the tapered section 228 connected to the nominal OD section 224). The lift nubbin 230 may provide an upset 232, e.g., a substantially 90 degree ("square") shoulder, extending radially outwards with respect to the tubular 202.

Referring now specifically to FIG. 4, in operation, the elevator 200 may receive the nominal OD section 224 of the tubular 202 (e.g., via a radially extending door), and may be slidable along the longitudinal axis of the tubular 202. The radial contact surface 118 of the fingers 104 may slide along the tubular 202, but may avoid sticking thereto, and thus may transmit minimal, if any, axially directed force on the slip bodies 204 by engagement with the tubular 202.

Referring to FIG. 5, the elevator 200 may be translated axially upwards, such that the fingers 104 engage the tapered section 228 of the tubular 202. The fingers 104, however, are flexible, as mentioned above, and thus may expand radially outward to accommodate the increasing radius R1 to R2 across the tapered section 228. Further, the radial range of motion R for the fingers 104 (FIG. 2) may be equal to or greater than the difference between the radii R2-R1. Further, the fingers 104 may be sufficiently flexible such that flexing of the fingers 104 by engagement with the tapered section 228 may not apply a sufficient axial force on the fingers 104 to cause the slip bodies 204 to overcome the biasing force applied by the spring 214. Accordingly, the flexing of the fingers 104 may allow the elevator adapter 100 to receive the increased OD section 226 without the teeth 206 engaging the tubular 202 (or at least not to a degree sufficient to substantially impede progression of the elevator 200), thereby allowing the elevator 200 to continue sliding upwards.

FIG. 6 illustrates continued sliding of the elevator 200 with respect to the tubular 202. The overall height H of the elevator adapter 100 may exceed the height B of the box connection. More particularly, the distance between the axial engagement surface 116 and top of the slip bodies 204 may be greater than the height B of the box connection. In some embodiments, the height of the fingers 104 alone may exceed the height B.

Accordingly, before the upper extent of the slip bodies 204 comes into contact with the lower edge of the tapered section 228, the axial engagement surfaces 116 of the fingers 104 may engage the upset 232 of the lift nubbin 230. In other embodiments, some contact between the slip bodies 204 and the lower edge of the tapered section 238 may be tolerated but substantial overlapping minimized. Continued upward force applied to the elevator 200, specifically to the elevator body 210, may transmit through the pin 212, to the slip bodies 204, the base 102 of the elevator adapter 100, and the fingers 104. The fingers 104, however, may prevented from continued movement upwards by axial engagement with the upset 23. Accordingly, a reactionary, axial force may be applied onto the slip bodies 204 via the fingers 104. The reactionary force may prevent the slip bodies 204 from further upward axial movement. Thus, the continued axial force on the elevator body 210 may overcome the biasing force of the spring 214, allowing the elevator body 210 to be displaced upwards relative to the slip bodies 204. This may result in the slip bodies 204 being displaced radially inwards via the engagement between the tapered surface 216 and the reverse tapered surface 218, which may cause the teeth 206 to be driven into engagement with the tubular 202.

Accordingly, it will be appreciated that the elevator adapter 100 may prevent the teeth 206 from engaging the tapered section 228, the increased OD section 226, or both of the box connection. Instead, the elevator adapter 100 may have a height H that exceeds the height B of the swaged box, allowing the teeth 206 to engage the tubular 202 below the tapered section 228 and on the nominal OD section 224. This may be accomplished, for example, via flexible extensions ("fingers") 104, which may flex radially outwards when they encounter the tapered section 228, and may axially engage the upset 232 so as to transmit the axial setting force onto the slip bodies 204.

Figure 8:
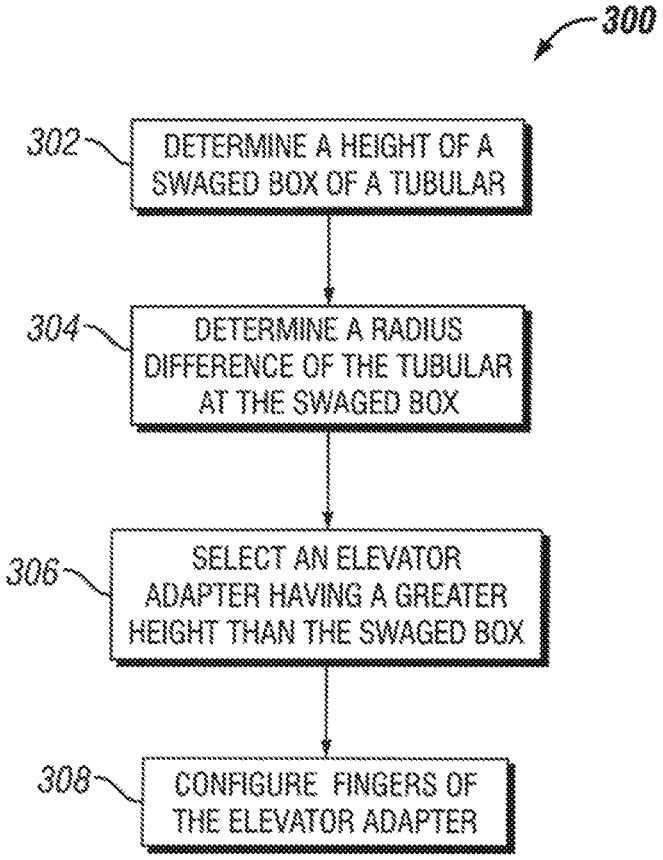
FIG. 8 illustrates a flowchart of a method for manufacturing an elevator adapter, according to an embodiment.

FIG. 8 illustrates as flowchart of a method 300 for manufacturing an elevator adapter, according to an embodiment. The elevator adapter resulting from the method 300 may be consistent with one or more embodiments of the elevator adapter 100 discussed above and thus may be best understood with reference thereto. Accordingly, for the sake of convenience, the method 300 is described with respect to the embodiments of the elevator adapter 100. However, it will be appreciated that the method 300 is not limited to any particular structure unless expressly stated herein.

The method 300 may begin with determining one or more dimensions of the tubular 202 with which the elevator adapter 100 is to be used. For example, the method 300 may include determining a height B of a swaged box of the tubular 202, as at 302 and determining a radial difference D between the radius R2 of the increased OD section 226 and the radius R1 of the nominal OD section 224, as at 304.

The method 300 may then proceed to configuring the elevator adapter 100 for use with the tubular 202, for example, according to the dimensions determined at 302 and 304. For example, the method 300 may include selecting components of the elevator adapter 100 such that the elevator adapter 100 defines a height H that is greater than the height B of the swaged box, as at 306. More particularly, the method 300 may include selecting the height of the base 102, and/or the axial extension (e.g., the plurality of fingers 104), so as to arrive at the appropriate height H.

Such configuring may also include configuring the axial extension (e.g., the plurality of fingers 104) such that the axial extension defines a radial range of motion R proximal an axial extent (e.g., the tip 114) thereof. The radial range of motion R may be selected to be greater than the difference between the radius R2 of the nominal OD section 224 of the tubular 202 and the radius R2 of the increased OD section 226 of the swaged box of the tubular 202, as at 308. Configuring at 308 may include selecting a material for the plurality of fingers 104, such as a polymer (e.g., cast polyurethane), as metal, or both. Configuring at 308 may also include defining (e.g., cutting, casting, etc.) as relief 120 in the axial extension so as to increase a flexibility thereof. Configuring at 308 may include various other selections, such as finger 104 shape, height, or thickness, relief 120 size and/or shape, and others.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An apparatus for adapting an elevator for use with a tubular, comprising:

one or more axial extensions configured to engage one or more slip bodies of the elevator, the one or more axial extensions comprising a radial contact surface configured to slide along the tubular and an axial engagement surface configured to bear on an upset of the tubular, wherein the axial engagement surface and the upset are substantially perpendicular to a central longitudinal axis through the tubular, wherein the axial engagement surface bearing on the upset of the tubular causes an axial force to be transmitted through the one or more axial extensions, which causes the slip bodies to be displaced radially inward, and wherein the one or more axial extensions are flexible such that the radial contact surface is radially displaceable with respect to the tubular.

2. The apparatus of claim 1, wherein the one or more axial extensions define a relief configured to increase radial flexibility.

3. The apparatus of claim 2, wherein the relief comprises a slot extending at least partially through the one or more axial extensions.

4. The apparatus of claim 1, further comprising a base coupled with the one or more axial extensions and the one or more slip bodies of the elevator.

5. The apparatus of claim 4, wherein the base is arcuate and extends between about 150 decrees and about 200 degrees so as to receive the tubular.

6. The apparatus of claim 5, wherein the one or more axial extensions comprises a plurality of elongate fingers disposed at angular intervals along the base.

7. The apparatus of claim 6, wherein the angular intervals are approximately uniform.

8. The apparatus of claim 4, wherein the base comprises a first plate coupled with the one or more slip bodies and a second plate coupled with the one or more axial extensions.

9. The apparatus of claim 8, further comprising a plurality of posts extending between and connecting together the first and second plates.

10. The apparatus of claim 1, wherein the axial extension defines a root configured to be located proximal to the one or more slip bodies and a tip on opposite axial side from the root, wherein the axial engagement surface is defined at the tip.

11. The apparatus of claim 1, wherein the one or more axial extensions are constructed at least partially from a polymer.

12. The apparatus of claim 1, wherein the one or more axial extensions engage the one or more slip bodies of the elevator, wherein the radial contact surface slides along the tubular, wherein the axial engagement surface bears on the upset of the tubular, and wherein the axial engagement surface bearing on the upset of the tubular directly creates the axial force.

13. An elevator, comprising:

an elevator body;

a plurality of slip bodies disposed at least partially within the elevator body and configured to move radially inwards when slid in an axial direction relative to the elevator body, so as to engage an outer diameter of a tubular; and an axial extension engaging at least one of the plurality of slip bodies and extending axially therefrom, the axial extension being flexible so as to flex radially outwards when the axial extension encounters a tapered section of the tubular, wherein, when the axial extension contacts an upset of the tubular, that is substantially perpendicular to a central longitudinal axis through the tubular, the axial extension bears upon the upset, which causes the axial extension to directly transmit a force to the plurality of slip bodies that causes the plurality of slip bodies to be displaced radially inwards and axially relative to the elevator body.

14. The elevator of claim 13, wherein the axial extension comprises one or more elongate fingers.

15. The elevator of claim 13, further comprising a base coupled with the axial extension and with at least one of the plurality of slip bodies.

16. The elevator of claim 15, wherein the base extends at least partially across at least two of the plurality of slip bodies.

17. The elevator of claim 15, wherein the base does not extend across at least one of the plurality of slip bodies.

18. The elevator of claim 15, wherein the axial extension comprises a root coupled with the base and a tip distal to the base, and wherein the axial extension defines a relief between the root and the tip, the relief being configured to reduce a stiffness of the axial extension.

19. The elevator of claim 15, wherein the base has an arc shape extending between about 150 degrees and about 200 degrees and defines an angular open section configured to receive a tubular.

20. The elevator of claim 19, wherein the axial extension comprises a plurality of elongate fingers disposed at generally uniform angular intervals along the arc shape of the base.

21. The elevator of claim 15, wherein the axial extension and the base define a height, wherein the height is predetermined so as to be larger than a distance from the upset of the tubular to an edge of the tapered section of the tubular.

22. The elevator of claim 13, wherein the axial extension defines a root positioned proximal to the plurality of slip bodies and a tip disposed distal to the plurality of slip bodies, wherein the axial extension defines a radial range of motion proximal to the tip thereof.

23. The elevator of claim 22, wherein the radial range of motion is greater than a difference between a radius of as nominal OD section of the tubular and a radius of an increased OD section of the tubular, the increased OD section of the tubular extending between the upset and the tapered section.

24. The elevator of claim 13, further comprises one or more springs within the elevator body, wherein the one or more springs maintain a position of the plurality of slip bodies until the axial extension bears on the upset.

25. A method of manufacturing an elevator adapter, comprising:

determining a height of a swaged box of a tubular; and selecting a height of the elevator adapter, such that the height is greater than the height of the swaged box, the elevator adapter comprising an axial extension that includes an axial engagement surface that bears on an upset of the tubular that is substantially perpendicular to a central longitudinal axis through the tubular, and wherein the axial extension is configured to radially expand when engaged with a tapered section of the tubular and to transfer an axial force to a plurality of slip bodies when the axial extension engages the upset of the tubular, wherein the axial force causes the plurality of slip bodies to extend radially inward.

26. The method of claim 25, wherein selecting the height of the elevator adapter comprises selecting a height of a base of the elevator adapter, or selecting a height of the axial extension, or both.

27. The method of claim 25, further comprising:

determining a difference between a radius of a nominal outer diameter section of the tubular and a radius of an increased diameter section of the swaged box of the tubular; and configuring the axial extension such that the axial extension defines a radial range of motion proximal an axial extent thereof, wherein the radial range of motion is greater than or equal to the difference between the radius of the nominal outer diameter section of the tubular and the radius of the increased diameter section of the swaged box of the tubular.

28. The method of claim 25, further comprising forming the axial extension as a plurality of elongate, separated fingers.

29. The method of claim 28, further comprising:

forming a base coupled to the axial extension and the slip bodies in an arc shape; and disposing the axial extensions at generally uniform angular intervals along the base.

30. The method of claim 28, further comprising forming a relief in the axial extension so as to increase flexibility thereof.

* * * * *